US005874689A

United States Patent [19]

Alkhatib et al.

[11] Patent Number: 5,874,689

[45] **Date of Patent: *Feb. 23, 1999**

[54] SHOT POUCH

[75] Inventors: Yousef F. Alkhatib, New Brighton; Jerome J. Rubatt, Coon Rapids; Jack H. Riedel, Shoreview, all of Minn.

[73] Assignee: Federal Cartridge Company, Anoka, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 867,180

[22] Filed: Jun. 2, 1997

Related U.S. Application Data

[60] Provisional application No. 60/028,338 Oct. 11, 1996.

[51] Int. Cl.[6] ..... F42B 7/08

[52] U.S. Cl. ..... 102/453; 102/532

[58] Field of Search ..... 102/448–463, 102/520–523, 532

[56] References Cited

U.S. PATENT DOCUMENTS

| | | | |
|---|---|---|---|
| 2,953,990 | 9/1960 | Miller | 102/449 |
| 3,299,813 | 1/1967 | Rickey | 102/451 |
| 3,598,057 | 8/1971 | Potter | 102/452 |
| 3,653,326 | 4/1972 | Howsam et al. | 102/450 |
| 3,721,194 | 3/1973 | Weston, Jr. | 102/499 |
| 4,197,904 | 4/1980 | Ferri . | |
| 4,635,555 | 1/1987 | Ferri . | |
| 5,528,989 | 6/1996 | Briese . | |

FOREIGN PATENT DOCUMENTS

| | | | |
|---|---|---|---|
| 1454931 | 10/1966 | France | 102/454 |

*Primary Examiner*—Harold J. Tudor
*Attorney, Agent, or Firm*—Schroeder & Siegfried P.A.

[57] ABSTRACT

A one piece shot cup (also commonly known as a shot pouch) designed especially for use in protecting the bore of a shotgun barrel when shooting hard shot made of a material such as tungsten or non-annealed steel. The cup is characterized by the use of shield members located opposite and outwardly of equally spaced tear lines which are defined by narrow areas of substantially weakened wall structure extending longitudinally of the cup. The shield members are connected to the wall structure of the tubular member only adjacent its closed rear end portion and are otherwise separate and free thereof. Portions of the tubular member extend between the circumferentially spaced shield members. The shield members prevent the shot, which ruptures the tear lines, from damaging the bore of the shotgun barrel. They also aid in holding the shot in an improved aligned relation to thereby improve the shot pattern. They also aid in causing the shot cup to separate from the shot immediately after leaving the end of the barrel of the gun. The tapered wall thickness of the pouch is within the range of 0.0601" at its front end and 0.080" at the rear end of the pouch.

30 Claims, 17 Drawing Sheets

SHOT POUCH

DESCRIPTION

BACKGROUND OF THE INVENTION

This application is an application for a patent which is also disclosed in Provisional Application Ser. No. 60/028,338, filed on Oct. 11, 1996, by the same inventors, namely Yousef Alkhatib, Jack H. Riedel, and Jerome J. Rubatt, and entitled "SHOT POUCH," the benefit of the filing date of which is hereby claimed.

In recent years, for environmental reasons, there has been a serious effort in the small arms ammunition industry, to provide shotshells which will utilize shot comprised of other than lead. Lead has been the usual metal from which shot has heretofore been produced, because of its weight and malleability. Lead, however, is toxic and the death of large numbers of waterfowl has been attributed to the ingestion of lead pellets by the authorities concerned about such problems.

Because of the above toxicity problems, much pressure has been brought to bear for providing shot which are nontoxic. Weight of the material from which the shot is made is important, because of the need for a heavy impact in order to minimize the number of wounded, but not harvested, waterfowl. As a consequence, attention has in recent years been directed to the use of tungsten or steel from which to produce such shot, since each of them is quite heavy and non-toxic.

Steel has some drawbacks, in that it is extremely hard and, consequently, tends to pierce the shot pouch (cup) and provide consequent inadequate ballistic qualities. Tungsten is even harder as compared to lead. A shot cup is generally used to confine such shot, but experience shows that they tend to pierce the sidewalls of the cup and damage the gun barrel bore. In view thereof, much of the steel shot is being annealed to reduce the damage to the bore of the barrel from such pouch-piercing shot. This annealing operation, of course, adds a step to the manufacturing process, which increases its cost and should, if possible, be eliminated. Since the annealed steel shot are softer, they more readily change shape under the high pressures to which they are subjected under firing, which in turn adversely affects pattern density, because the flattened surfaces, resulting from such changes in shape, cause the shot to reduce speed and tumble, or otherwise suffer undesirable ballistics.

Tungsten shot are 94% as heavy as lead shot having a 3% antimony content and considerably heavier than steel and, therefore, induce greater impact than steel striking the target. Since tungsten is heavier than steel, it requires a lesser volume to contain a tungsten charge than a steel charge having an equal weight.

From the above, it can be seen that there still is a definite need for a shot charge which is nontoxic, has adequate weight, and will not damage the bore of the shotgun barrel. Our invention is directed toward providing such a charge, to enable the shooter to utilize the harder shot, such as those made of tungsten and steel, without annealing same and without piercing the shot cup, with consequent borescoring disadvantages. We accomplish this goal through the use of a uniquely designed shot pouch, which protects the bore of the gun barrel and thereby enables the shooter to utilize non-annealed steel and/or tungsten shot, without serious damage to the bore surface of the barrel of the shotgun.

Shot cups (pouches) have been used for many years and have many variations in design to accomplish a variety of purposes. One of the most commonly used designs is shown in FIG. 3 of U.S. Pat. No. 4,481,885, in which a tubular cup, having a continuous tubular wall structure, is shown. Such cups frequently have spaced longitudinal slits in the sidewalls, which are provided for use with the relatively soft lead shot. Such slitted sidewalls are intended to facilitate separation of the shot cup from the shot pellets, upon firing of the shotshell. Such slits are circumferentially spaced and extend radially through the tubular sidewall. It is believed, however, that the shot cup having the continuous tubular wall structure, such as is shown in the above patent, is the closest prior art.

BRIEF SUMMARY OF THE INVENTION

Our invention is designed to protect the bore of the barrel of a shotgun while improving the ballistic properties of the charge. It includes a unique tubular structure of the shot pouch in which the cylindrical wall structure of the pouch is constructed to provide circumferentially and equally spaced, longitudinally extending parallel tear lines comprised of substantially thinned narrow area designed to be torn along such lines by the shot, rather than through the thicker intermediate areas between such tear lines. To further protect the bore of the barrel, we provide relatively wide and much thicker elongated shield or petal members, which extend externally and longitudinally of the tubular member and directly radially opposite said tear lines and therealong to effectively shield the bore of the gun barrel. The thickness of the wall at the narrow tear areas of the mouth of the pouch is approximately only 0.002" and the thickness of the shield member directly opposite the tear line at the mouth is approximately 0.050". The thickness of the wall structure at the mouth of the pouch and between said tear lines is approximately 0.060". The thickness of the wall structure at the lower end of the tubular member is approximately 0.080".

In use, our shot pouch will be torn by the shot pellets at the tear line, first adjacent the forward end of the pouch and then progressively toward its base or rear end. The shield members which are located in juxtaposition directly radially outwardly of the narrow tear lines will engage the shot as they protrude through the tear line and will preclude contact between said shot and the bore of the barrel, thereby protecting the bore from being scored.

Wherever herein we utilize the term "tear line" or "tear line areas," in designating the narrow thinned areas, it is intended to include the connotation of a slit or slits in the tubular wall of the shot pouch, which extend longitudinally of said wall and define therebetween separate tongues within which the shot is maintained, prior to firing of the shotshell of which the shot pouch is a part.

Our invention also protects the shot and maintains its spherical shape, to thereby enhance the shot pattern density. It also enables the shooter to utilize non-annealed steel shot which improves its aerodynamics and reduces cost of manufacture. By eliminating the need for annealing the shot, we reduce the cost of producing the shot charge. In addition, the shield members catch the air immediately upon leaving the end of the gun barrel and swing outwardly, which separates the pouch from the shot charge more quickly and effectively, to thereby increase the effectiveness and accuracy of the shot charge.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

Figure 35:
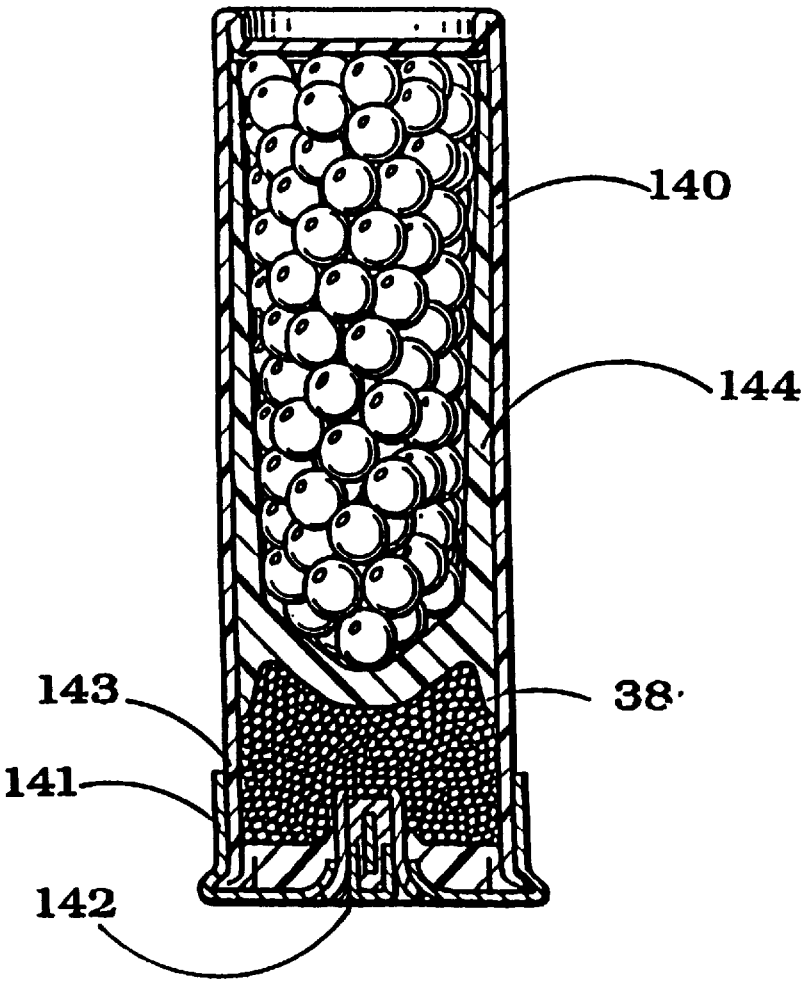
(Prior Art) Fig. 35
FIG. 35 shows, as Prior Art, the shot cup shown in FIG. 3 of U.S. Pat. No. 4,481,885.

FIG. 35 exemplifies the prior art and shows a plastic tubular member 144, 37 which has a continuous tubular elongated body for containing shot therewithin and being positioned within the casing of a shotshell. As shown, it has a depending skirt 38 similar to that shown and claimed herein. It is this type of shot pouch which we have described as being penetrated by hard shot, such as those made of tungsten or steel, and which score the bore of the barrel of the shotgun when this takes place.

Figure 1:
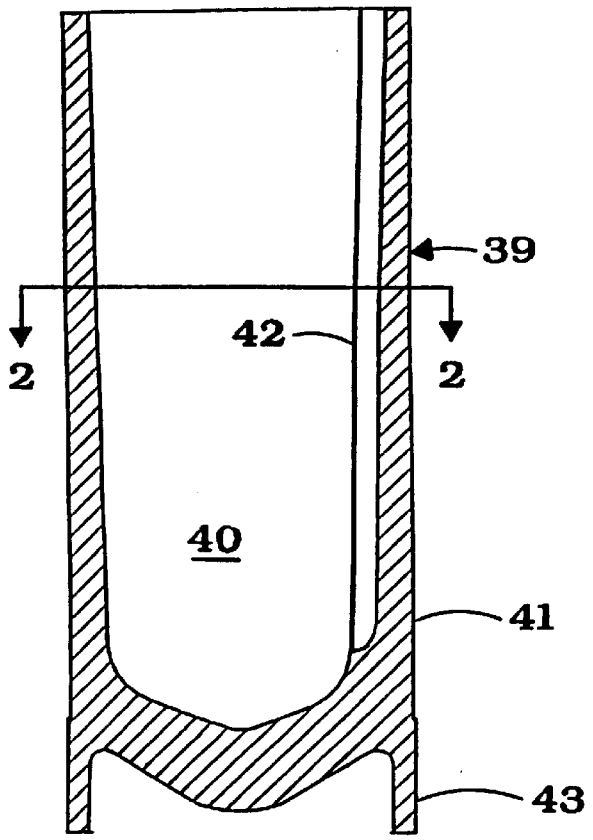
FIG. 1 is a longitudinal sectional view of the preferred form of our invention.
Figure 2:
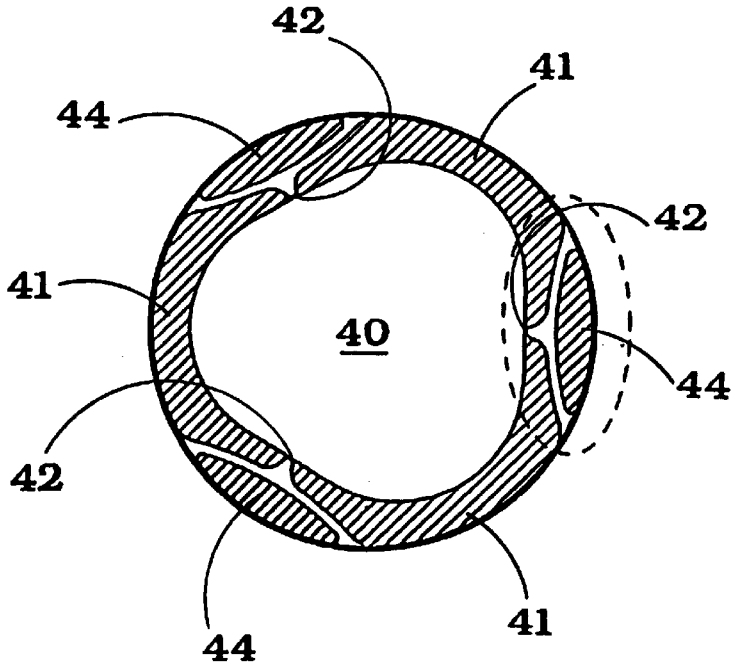
FIG. 2 is a cross-sectional view of the shot pouch shown in FIG. 1, taken long line 2—2 of FIG. 1.
Figure 3:
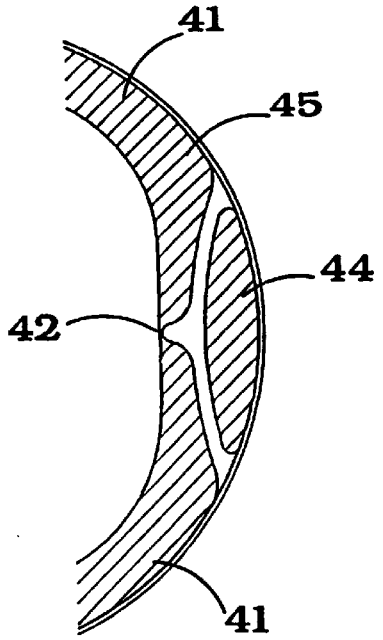
FIG. 3 is an enlarged sectional view of the encircled areas, as shown in FIG. 2, above.
Figure 4:
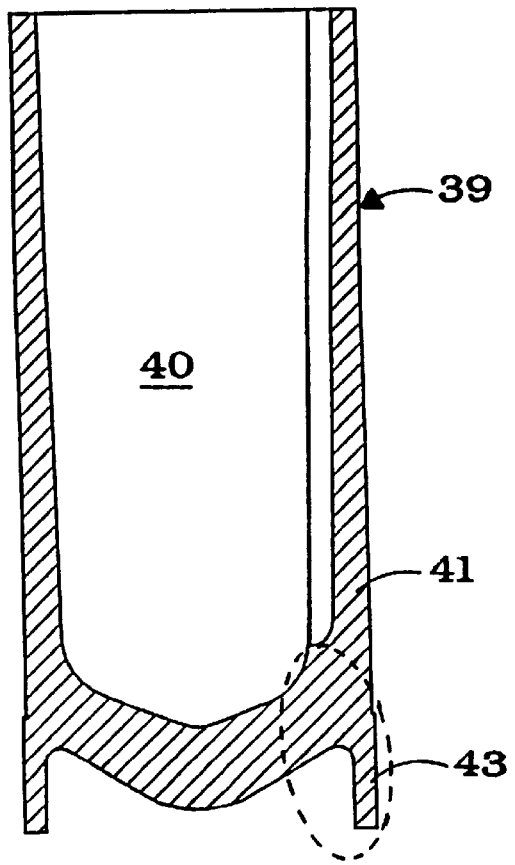
FIG. 4 is a longitudinal sectional view of a second shot pouch constructed like the pouch of FIG. 1, but having different dimensions.
Figure 5:
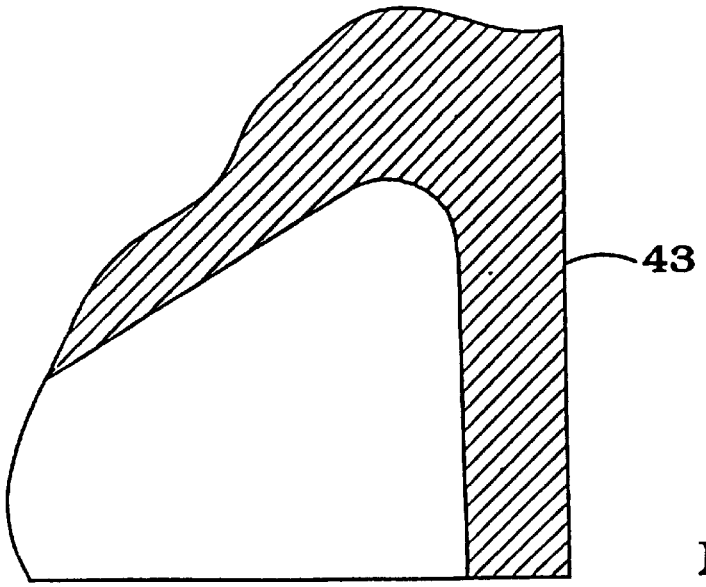
FIG. 5 is an enlarged fragmentary sectional view of the encircled area, as shown in FIG. 4.

FIG. 1 shows a preferred form of our shot pouch invention, as presently known. As shown, it is comprised of an elongated plastic tubular member 39 which, as shown in FIG. 2, has a generally triangular shaped interior 40, which is defined by the sidewalls 41 of the shot pouch, which have a cylindrical exterior surface, and which is adapted to conform and fit snugly within the casing of a shotshell. The sidewall adjacent the corners of the generally triangular shape, as at 41 in FIG. 1, have a thickness of approximately 0.060–0.080" at the lower rear end of the cavity of the tubular member and a thickness of approximately 0.050–0.060" at the forward end of these portions of the tubular member.

At the center of the side areas of the triangular shape, there is a pronounced narrow thinning or preslitting of the sidewalls of the tubular member, as at 42. This pronouncedly narrow thin area extends from the mouth of the tubular member 39 to a point adjacent the bottom thereof, as shown in FIG. 1. As shown in FIG. 2, the walls increase rapidly in thickness, as you move away from the thinned area 42. The thinned area is designated as a tear line, because tungsten or steel shot contained within the cavity 40 will cause that line to be ruptured, and the shot will seek to protrude therethrough, upon firing.

Wherever herein the term "tear line" is utilized, it is intended to include a slit which extends longitudinally of the tubular member 39, in lieu of the narrow thinned area 42, for obviously, a narrow slit may function substantially equally as well as thinned area 42, since the abutting edges which define such a slit will highly resemble the torn areas along the tear line, once the latter is torn.

It should be realized that, when a shotshell is fired, the propellant which is located behind the rear end of the tubular member 39, and within the skirt 43, causes the tubular member 39 and its contents to be ejected from the casing of the shotshell, such as is shown in FIG. 37. Upon firing, the shot charge contained within the tubular member 39 tends to shift rearwardly toward the bottom of the tubular member 39, which in turn increases the radial forces created by inertia of the shot. This causes the narrow tear line 42 to yield and/or rupture, with the result that the shot tend to seek to protrude through the tear lines.

As the pressure builds up within the skirt upon propellant ignition, the skirt flares out to provide the desired pressure seal. When the pressure reaches its peak, the tubular member 39 will exit from the shell casing into the barrel chamber and the preslit or tear line will be completely torn, if it has not yielded previously. As a result of the open slit resulting from the tearing of the tear line area, the shot will follow the path of least resistance and attempt to pass through the newly formed slit.

Extending forwardly from the rear end portion of the tubular member 39, by which they are supported, from a position radially opposite the tear lines 42, are a plurality of petal or shield members 44. As shown, these shield members are oval in shape, wider than the tear lines, are discrete relative to the sidewalls of the tubular member 39 and extend forwardly from a position immediately adjacent the rear end of the tear line and taper, as best shown in FIG. 1. Wherever herein the term "discrete" is used, it is intended to indicate that the elements referred to are readily recognizable and distinguishable as to form and function, but may be connected at one of their ends. As shown, each shield member 44 is connected to only the closed rear end of the tubular member 39 and otherwise is separate and free of the tubular member. The free forward end of each of the shield members 44 is 0.060–0.070" in thickness, and at its rear end is 0.060–0.080". As shown, however, they taper, becoming gradually thinner from the rear to the forward tip of the tubular member. It will be noted by reference to FIG. 2 that a portion of the tubular member 39 extends between each adjacent pair of shield members 44.

It should be noted that the narrow tear line 42 has a thickness of approximately 0.002" and, therefore, is substantially weaker than the remaining sidewall of the tubular member. Thus, as shown above and in FIG. 2 of the drawings, the shield members have a radial thickness, opposite the wall areas immediately adjacent the tear lines of the tubular members, which is substantially greater than that of said immediately adjacent areas. It should also be noted that the thickness of the sidewall increases abruptly immediately adjacent the narrow restricted area 42, and that the thickness of the adjacent sidewall gradually increases, until it reaches the full radial dimension of the sidewall 41. Note that the shield member 44 extends circumferentially a substantial distance beyond each side of the tear line 42 and cooperates with the sidewalls adjacent the weakened areas, which gradually increase in thickness, to preclude the passage of any of the shot to the exterior of the tubular member 39. The skirt of tubular member 39 has been designated by the numeral 43. The wall portions of the tubular member 39, between the thinned areas 42, are designated by the numeral 45.

Figure 6:
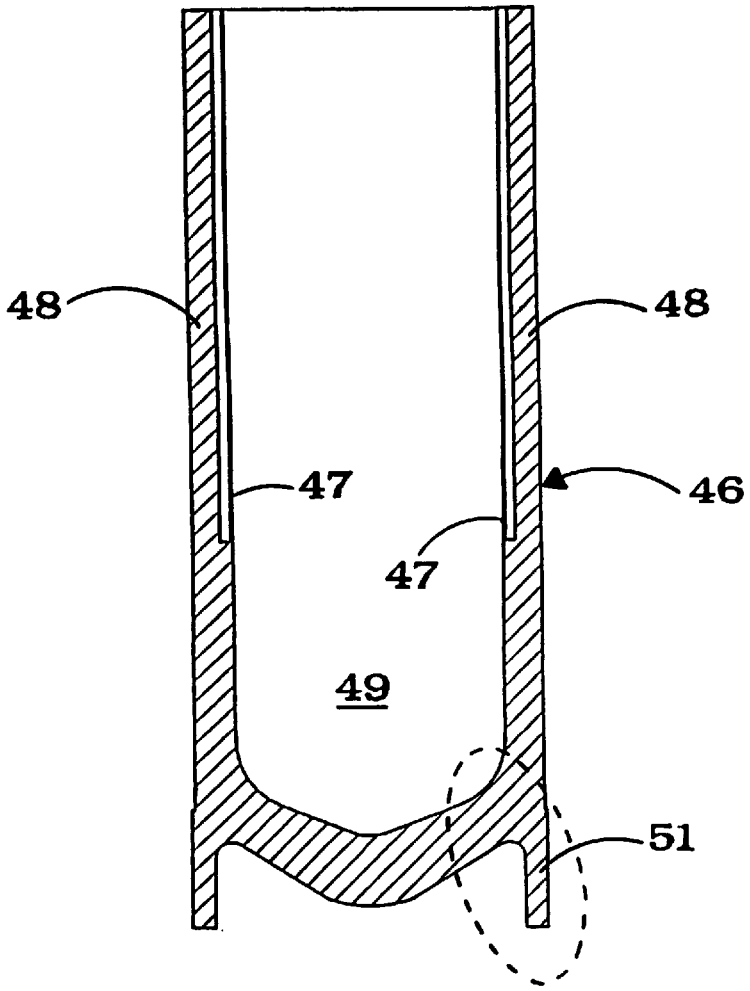
FIG. 6 is a longitudinal sectional view of a second embodiment of our invention.
Figure 7:
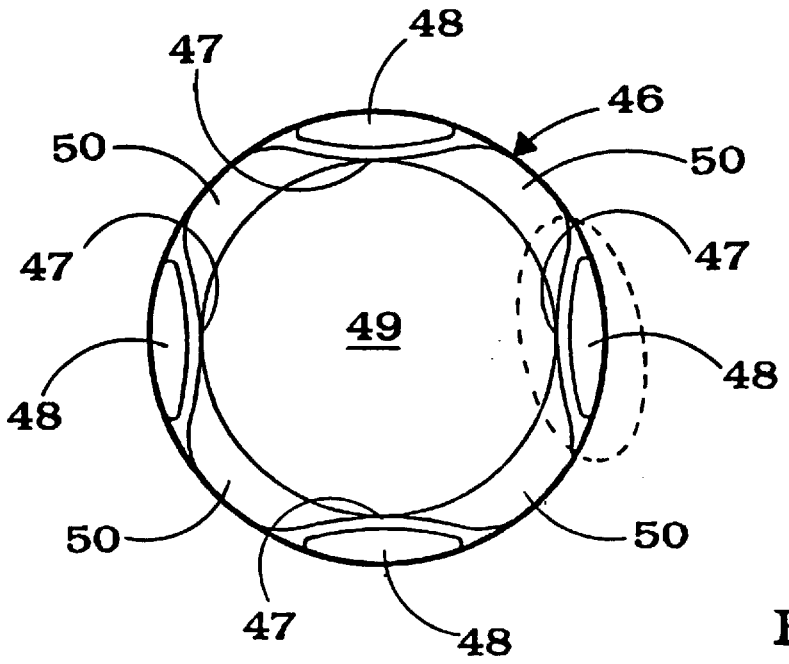
FIG. 7 is a front end elevational view of our shot pouch, as shown in FIG. 6.
Figure 8:
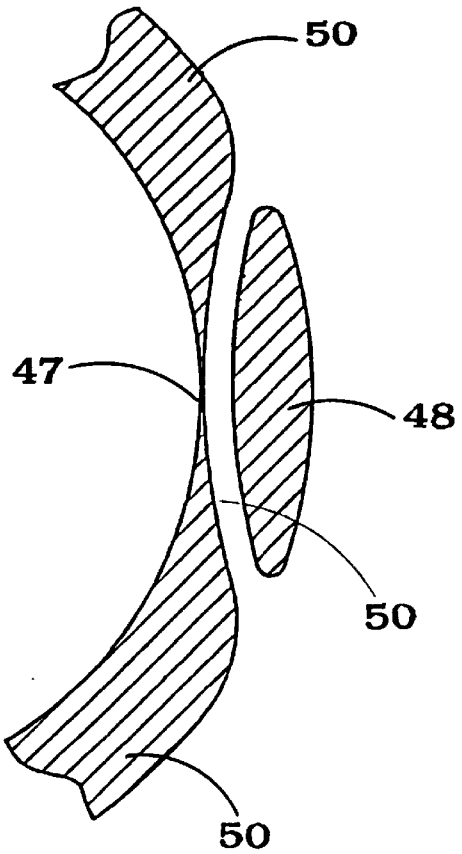
FIG. 8 is an enlarged sectional view of the encircled area, as shown in FIG. 7.

FIG. 6 shows a second form of our invention. As shown, it includes a plastic tubular member. 46, similar in many respects to that shown in FIG. 1, but differing in certain details. For example, the tear lines 47 are substantially shorter than the tear line shown in FIG. 1, and terminate at their rear ends approximately one-third of the distance forward of the bottom of the cavity of the tubular member. The shield members 48 likewise have rear ends which terminate opposite the rear end of the tear lines 47 and taper gradually inwardly toward their front end. It will be seen, however, that the interior 49 of the tubular member 46 is circular in cross-section, and that the tear lines 47 are four in number, each located 90° away from its adjacent tear lines. Note that the sidewall portions 50, which are located between the tear lines 47, do not increase abruptly in thickness as those shown in FIG. 2. Note also that the configuration of the shield members 48 is such that the surface at opposite sides of the tear line 47 conforms to the outline of the surface of the walls 50 at either side of the tear lines.

Figure 9:
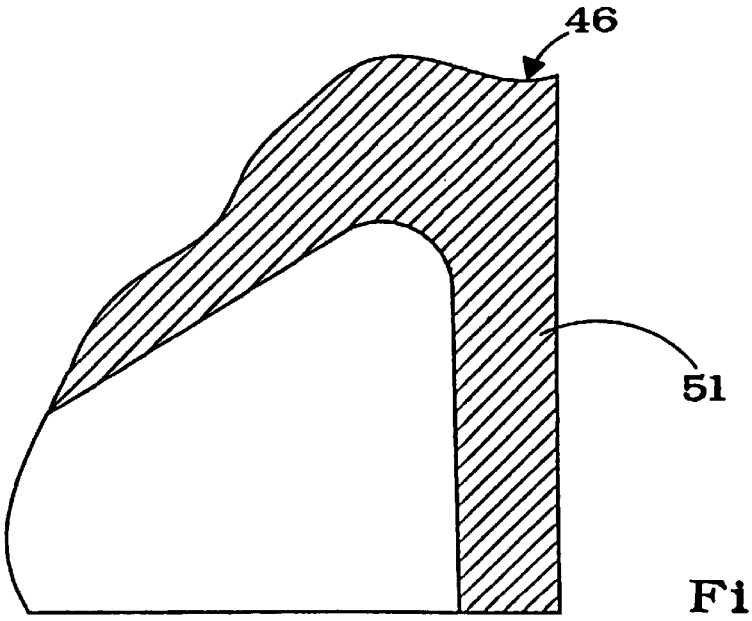
FIG. 9 is an enlarged sectional view of the encircled area, as shown in FIG. 6.
Figure 10:
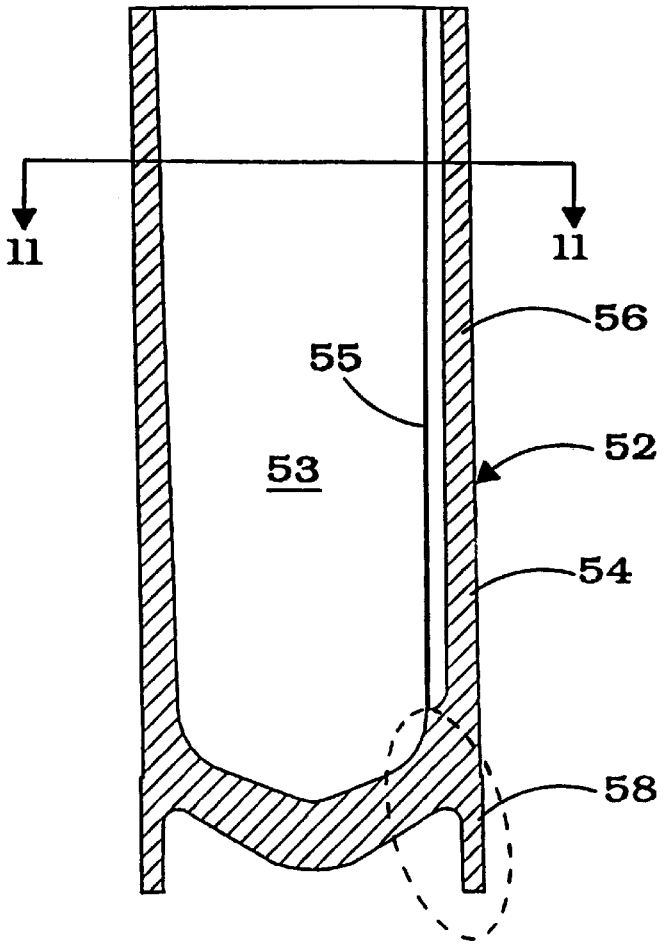
FIG. 10 is a longitudinal sectional view of a third embodiment of our invention.
Figure 11:
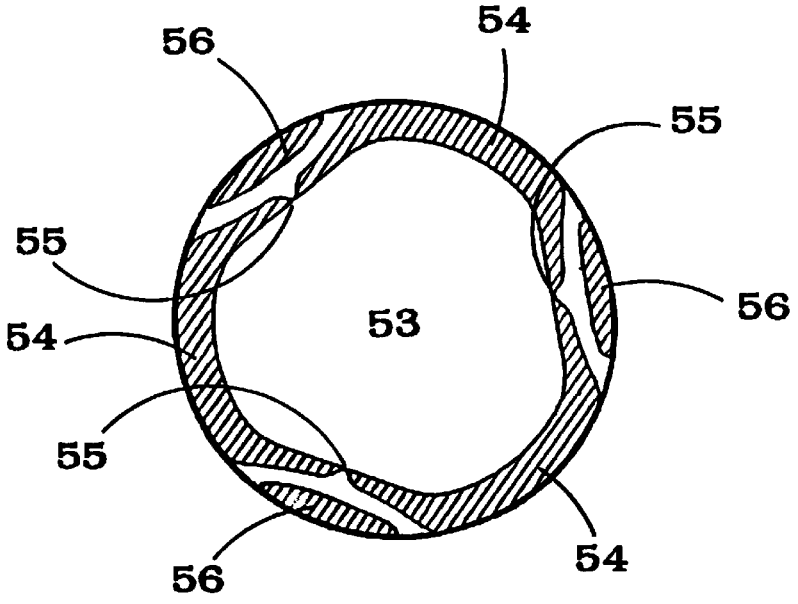
FIG. 11 is a cross-sectional view of the slot pouch shown in FIG. 10, taken along line 11—11 of FIG. 10.
Figure 12:
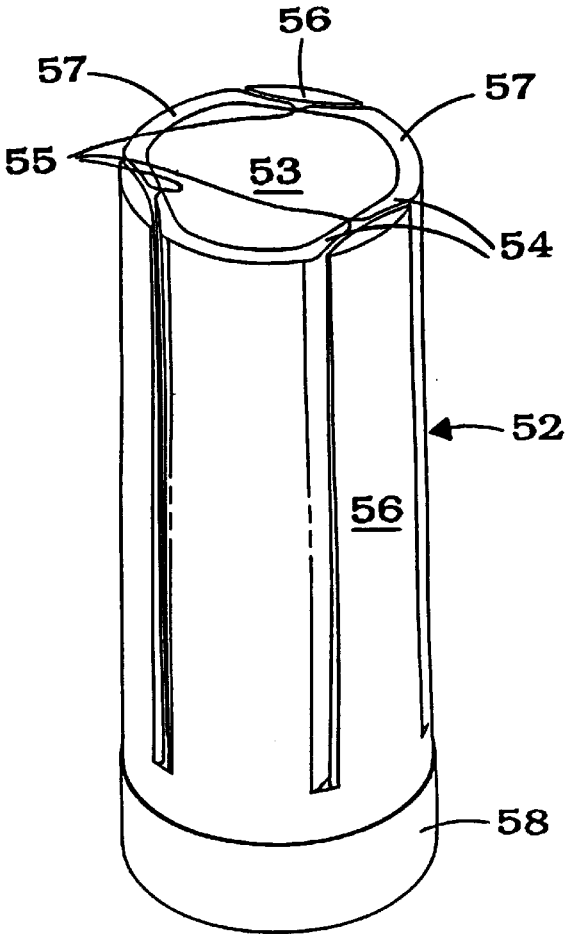
FIG. 12 is an enlarged perspective view of the shot pouch shown in FIG. 10.
Figure 13:
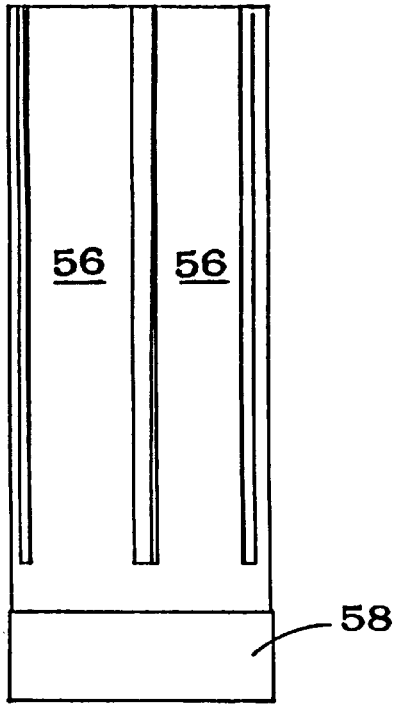
FIG. 13 is a somewhat reduced side elevational view of the shot pouch shown in FIG. 12.
Figure 14:
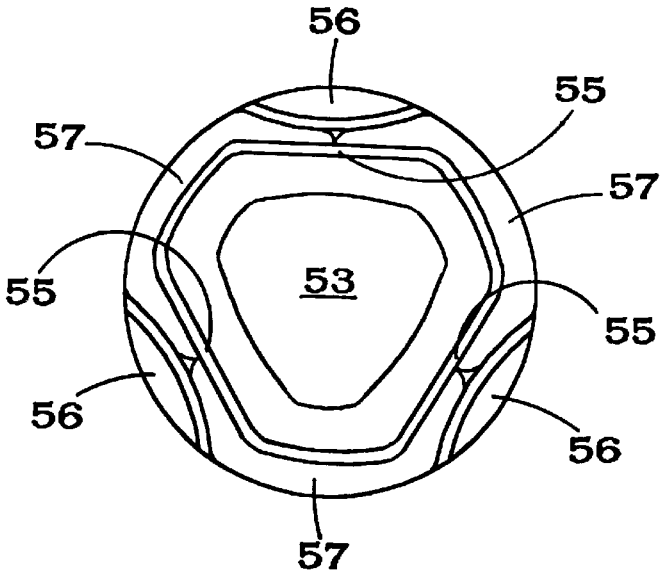
FIG. 14 is a front end elevational view of the shot pouch shown in FIG. 13.
Figure 15:
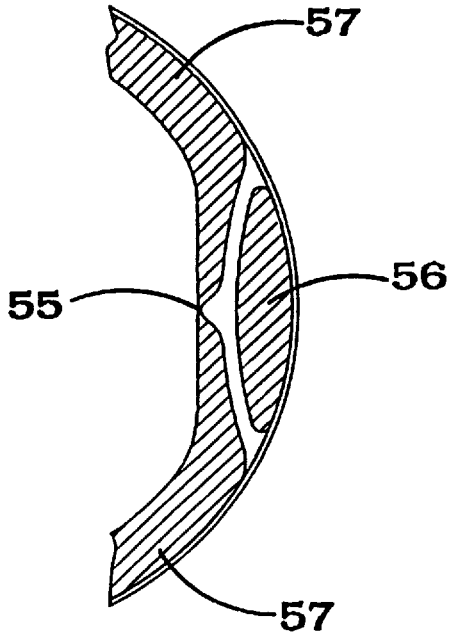
FIG. 15 is an enlarged sectional view of the encircled area, as shown in FIG. 11.
Figure 16:
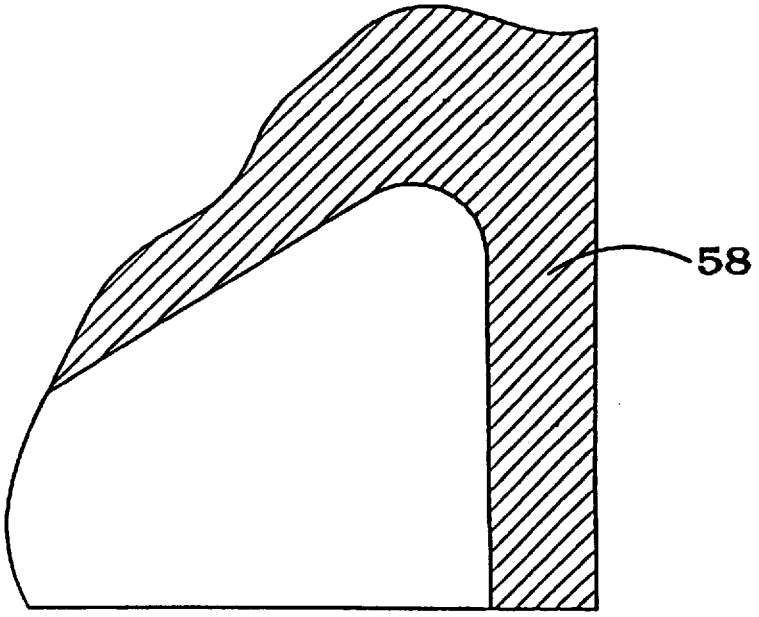
FIG. 16 is an enlarged sectional view of the encircled area, as shown in FIG. 10.

It will be seen, by reference to FIGS. 6 and 9, that the tubular member 46 has a skirt member 51 extending rearwardly from the bottom of the tubular member. This skirt member 51, like the skirt 43, perfects a seal behind the tubular members, when the propellant, which is positioned within the skirt 51 and immediately behind the tubular member, is fired to cause the tubular member and its shot charge to be ejected through the barrel of the gun in which the shotshell has been fired. The skirts shown in each of the forms of our invention herein perform the same function as described immediately hereinabove. Likewise, the tear lines and the shield members in each form of our invention, as disclosed herein, perform the same function and operate generally in the same manner.

The third form of our invention, as shown in FIGS. 10–14 inclusive, includes a plastic tubular member 52, in which the interior cavity 53 of that member is generally triangular in shape, somewhat like FIG. 1, but differs in the thickness of the walls of the tubular member immediately adjacent the tear lines, and increases in thickness more gradually than the form shown in FIG. 2. Thus, the portions of the sidewalls 54 of the tubular member, which are located immediately adjacent the tear lines 55, are not as thick as the corresponding portion shown in FIG. 2, and increase in thickness more gradually, as can be seen by comparison of such portions in FIG. 2 and 11. The shield members 56 taper toward the open front end of the tubular member 52, and are slightly spaced from the interior wall surface which defines the opening 53 of that member. The numeral 58 identifies the skirt of the tubular member 52.

Figure 17:
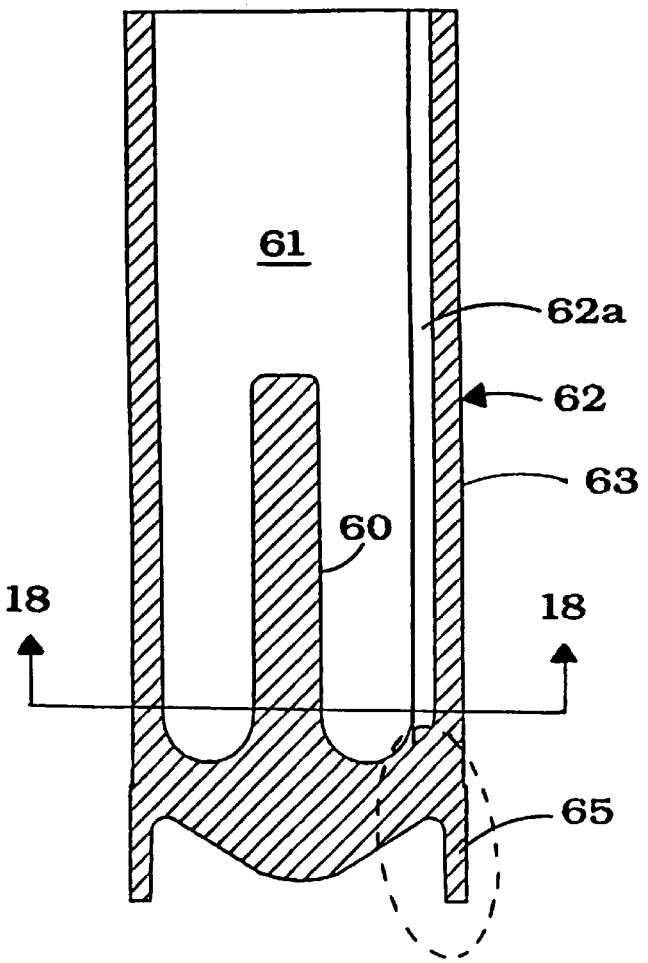
FIG. 17 is a longitudinal sectional view of a fourth form of our invention.
Figure 18:
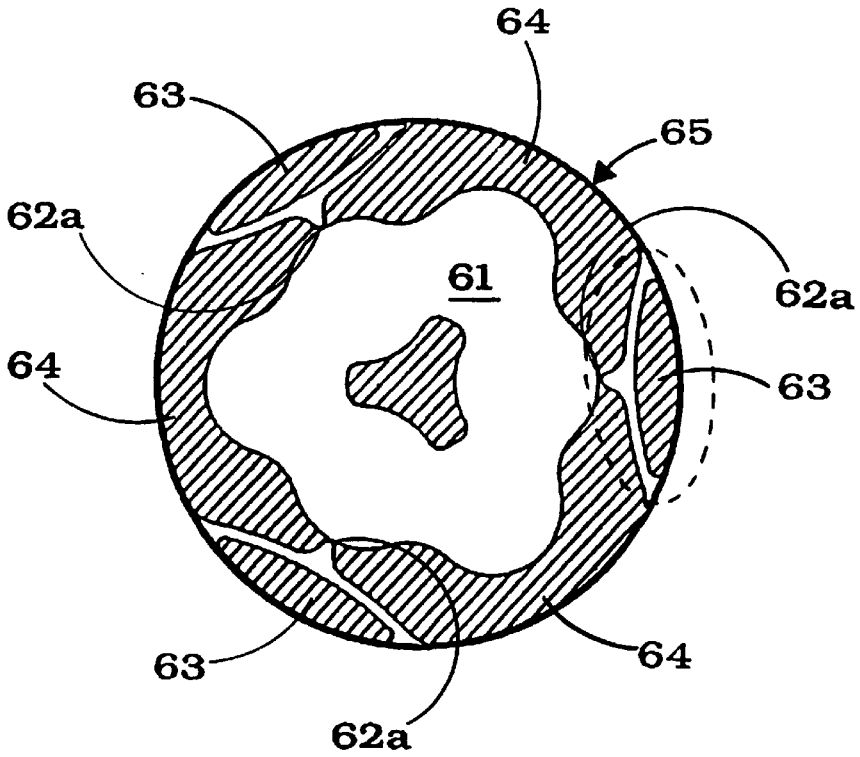
FIG. 18 is a cross-sectional view, taken along line 18—18 of FIG. 17.
Figure 19:
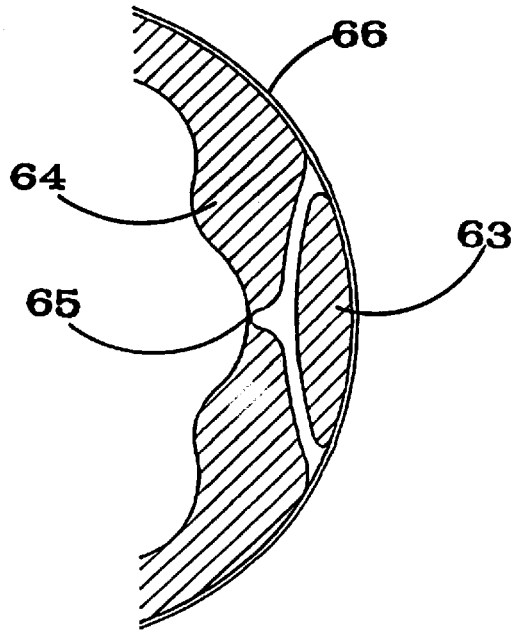
FIG. 19 is an enlarged sectional view of the encircled area shown, in FIG. 18.
Figure 20:
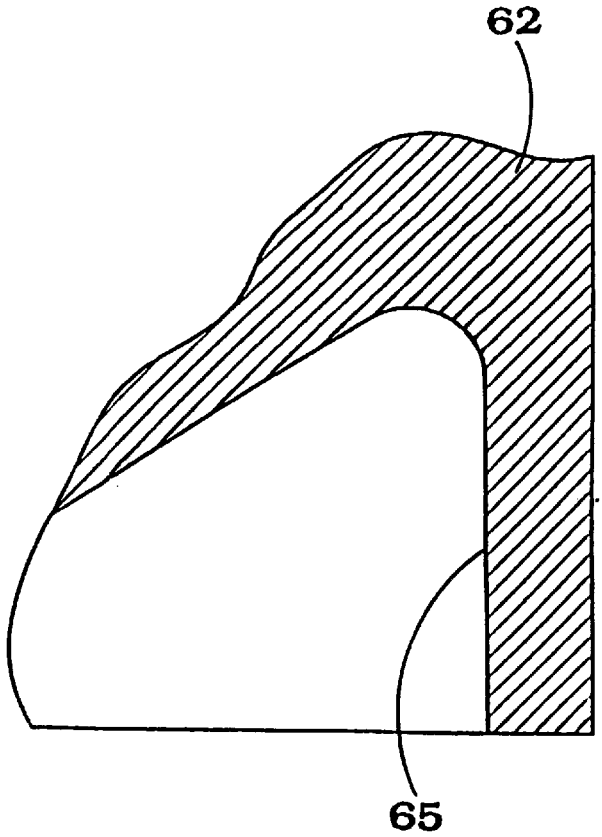
FIG. 20 is an enlarged sectional view of the encircled area shown in FIG. 17.

FIG. 17 shows a longitudinal sectional view of a fourth form of our invention, which is shown in FIGS. 17–20, in which a centrally disposed post 60 extends upwardly from the closed bottom of the cavity 61 of the tubular plastic member 62. This post 60 is generally triangular in shape and extends forwardly a distance approximately one-half of the length of the cavity 61. As shown in FIG. 18, the cavity 61, although generally triangular in cross-sectional shape, has an irregular contour, but the tear lines **62*a* are each located centrally of the sidewalls of the generally triangular configuration. Shield members 63 extends upwardly from the rear end of the tubular member in a manner similar to that shown in FIG. 1, and are located directly outwardly of one of the tear lines 62*a*, so as to function for the same purpose as that described with respect to FIG. 1. It should be noted, however, that the thickness of the walls 64, which extend between the tear lines 62*a***, increases abruptly very near the tear lines.

The function of the central post 60 is to aid in maintaining alignment of the shot in a line parallel to the longitudinal center line of the tubular member. The function of the skirt 65, like that shown in FIG. 1, is to perfect a seal to cause the propellant to operate most efficiently. The numeral 66 identifies the outer cylindrical surface of the tubular member 68.

Figure 21:
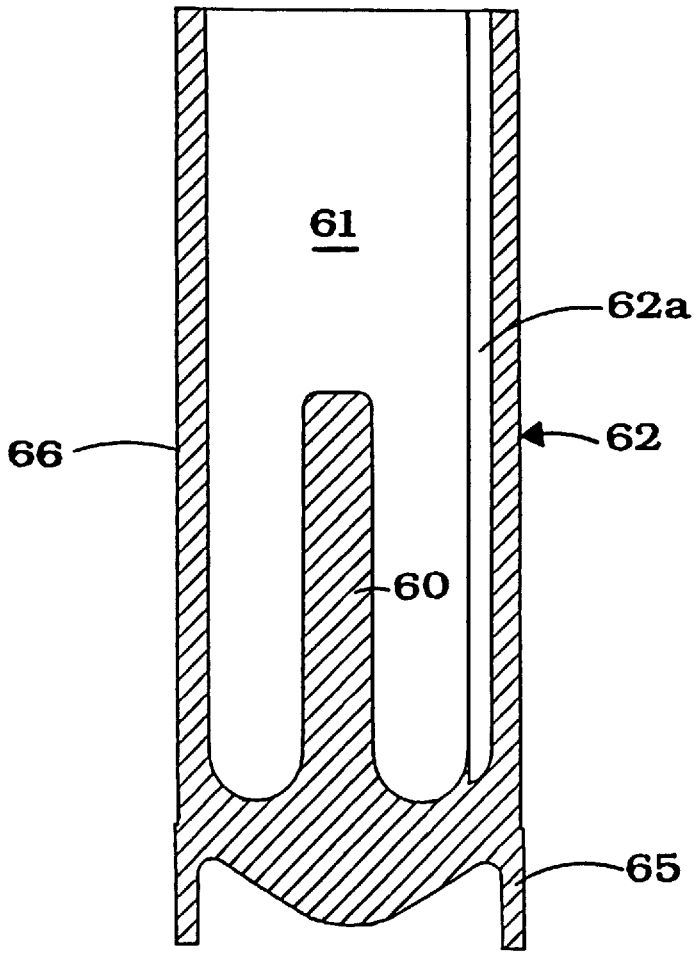
FIG. 21 is a longitudinal sectional view of a shot pouch similar to that shown in FIG. 17 and hence, bearing similar numerals, but having different dimensions.

FIG. 21 shows a longitudinal sectional view of a shot pouch, similar to that shown in FIG. 17, but having different dimensions. Accordingly, the corresponding marks have been identified by the same numerals as utilized in FIGS. 17–20, inclusive.

Figure 22:
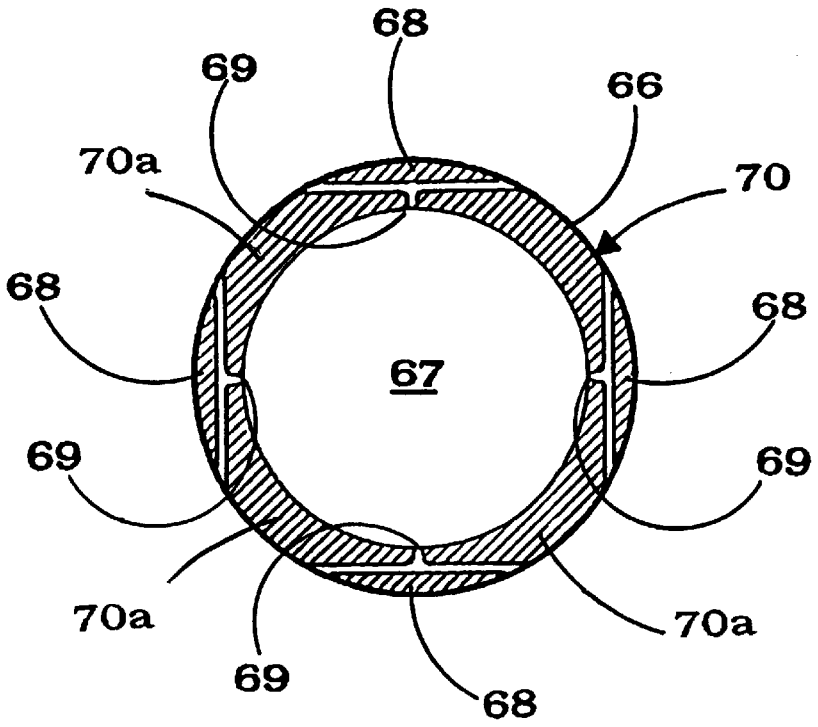
FIG. 22 is a cross-sectional view of a fifth embodiment of our invention, like that shown in FIG. 1, but having a circular inner surface and four tear lines.

FIG. 22, is quite similar to that shown in FIG. 1, but has a circular inner surface which defines its circular cavity 67. As shown, however, the shield members 68 are substantially thinner but, as in FIG. 1, they are disposed radially outwardly and directly opposite the tear lanes 69. Also, it will be noted that the wall portions 70*a*, which extend between the tear lines 69, increase in thickness abruptly immediately adjacent the tear lines, as compared to those shown in FIG. 2. The primary difference, however, in these two embodiments of the invention is the shape of the interior cavity of the tubular member. The numeral 70 identifies the elongated tubular member, generally, which is otherwise similar to member 39 of FIG. 1.

Figure 23:
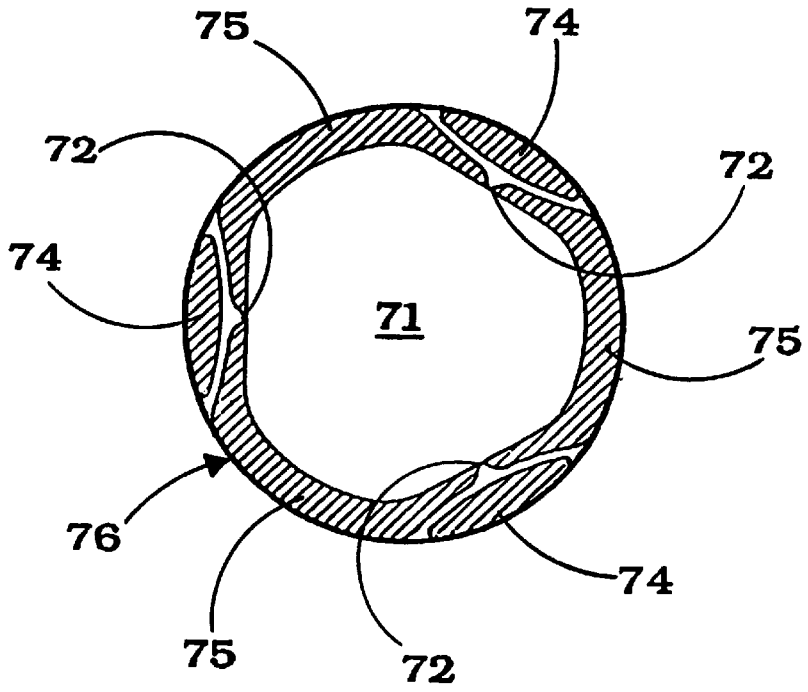
FIG. 23 is a cross-sectional view of a sixth embodiment of our invention similar to that shown in FIG. 1, but having a different cross-section.

FIG. 23 shows a shot pouch generally similar to FIG. 1, the interior of which has six sides, and is identified by the numeral 71. However, the interior is still basically a triangular configuration, and the tear lines 72, as in each of the other forms of the invention, are located midway between the corners of the triangle at each of its sides. Likewise, the shield members 74 are elongated and are located radially outwardly and directly opposite the tear lines 72. The sidewall portions 75 of the tubular member, which extend between the tear lines 72, do not increase in thickness adjacent the tear lines 72 as abruptly, as shown in some of the other embodiments of our invention herein, immediately adjacent the tear lines. The numeral 76 identifies the tubular member, generally, which is otherwise similar to member 39 of FIG. 1.

Figure 24:
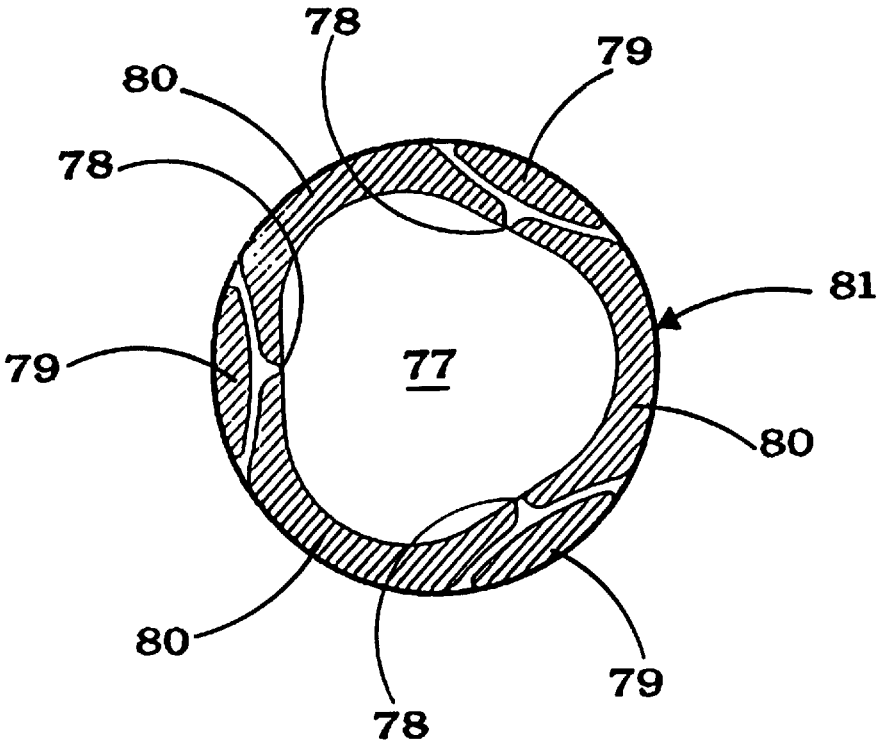
FIG. 24 is a cross-sectional view of a seventh embodiment of our invention similar to that shown in FIG. 1, but having a different cross-sectional shape.

FIG. 24 is a cross-sectional view of another embodiment of our invention, featuring a slightly different configuration of the interior 77 of the tubular member 81. It will be seen that the tear lines 78 are each located midway between the corners of the triangular configuration, and the elongated shield members 79 are each disposed radially outwardly and directly opposite the tear lines. It will be seen that the walls 80, which extend between the tear lines 78, increase in thickness immediately adjacent the tear lines 78. The numeral 81 identifies the elongated tubular member, generally, which is otherwise similar to member 39 of FIG. 1.

Figure 25:
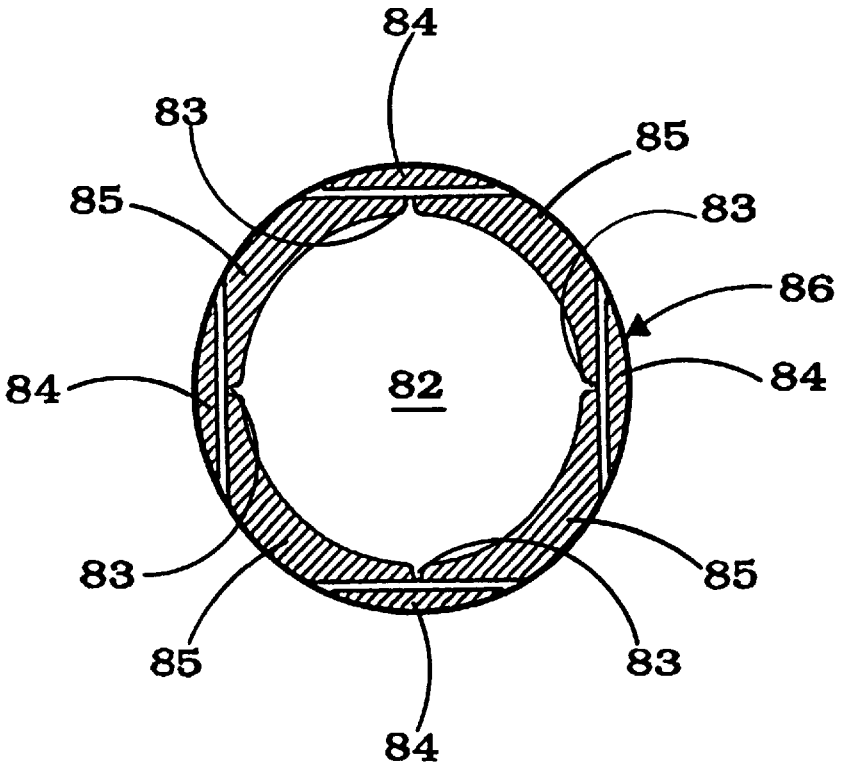
FIG. 25 is a cross-sectional view of an eighth embodiment of our invention similar to that shown in FIG. 1, but having a different cross-sectional shape.

FIG. 25 is a cross-section of an additional tubular shot pouch design, which is a part of our invention. As shown, the interior 82 is generally circular in configuration in cross-section, and there are four tear lines 83 located directly inwardly of four shield members 84. Note, however, that the tear line 83 in each instance is formed at the outer surface of the walls 85, which extend between said tear lines, in contrast to those shown in FIGS. 22–24, for example, in which the tear lines are located at the inner surface of such walls. The numeral 86 identifies the elongated tubular member, generally, which is otherwise similar to member 39 of FIG. 1.

Figure 26:
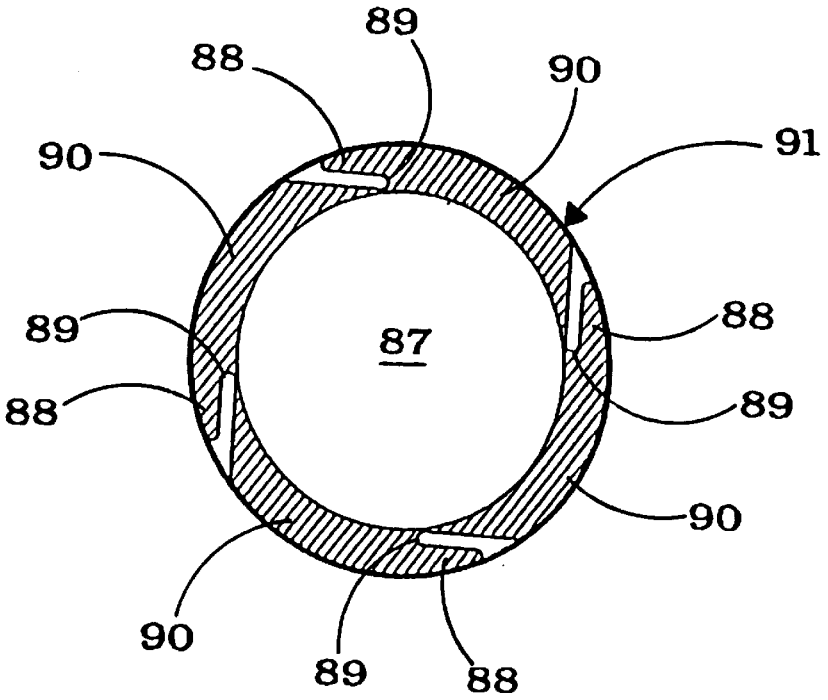
FIG. 26 is a cross-sectional view of a ninth embodiment of our invention similar to that shown in FIG. 1, but having a circular inner wall and a different form of shield member.

FIG. 26 shows another embodiment of our invention in cross-section, in which the interior 87 is circular in cross-section, and in which the shield members 88 are a part of the walls immediately adjacent the tear lines 89. Note that the shield members are designed similar to a flap, and are free at only one edge thereof, to effectively block the passage of any shot pellet which may attempt to escape through the area between the shield member 88 and the wall 90 at each side of the tear line 89. Numeral 91 identifies the tubular member, generally, which in all other respects is similar to tubular member 39 of FIG. 1.

Figure 27:
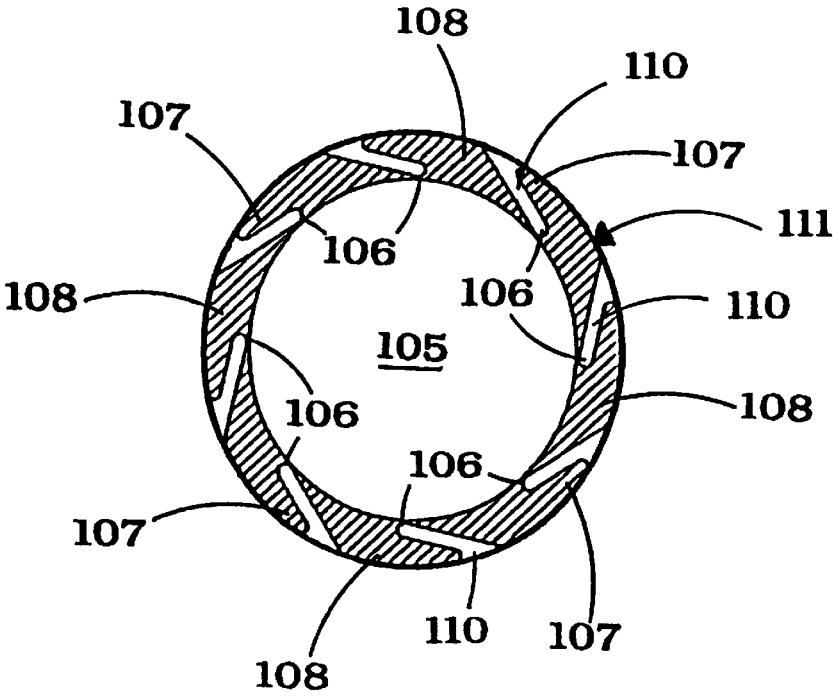
FIG. 27 is a cross-sectional view of a tenth form of our invention, similar to that shown in FIG. 1, but having a circular inner wall and different form of shield member.

FIG. 27 shows a cross-sectional view of an additional embodiment of our invention, in which the plastic tubular member has a circular interior 105 and eight different tear lines 106. It will be seen that the shield elements 107 are in the form of a flap or lip, which extends circumferentially of the tubular member, and defines a small passageway between the same and the walls 108 of the tubular member, which extend between the adjacent tear lines. The shield elements 107 and walls 108 preclude the passage of shot pellets through the circumferentially extending passageways 110. The numeral 111 identifies the tubular member, generally, which otherwise is similar to the tubular member 39 of FIG. 1.

Figure 28:
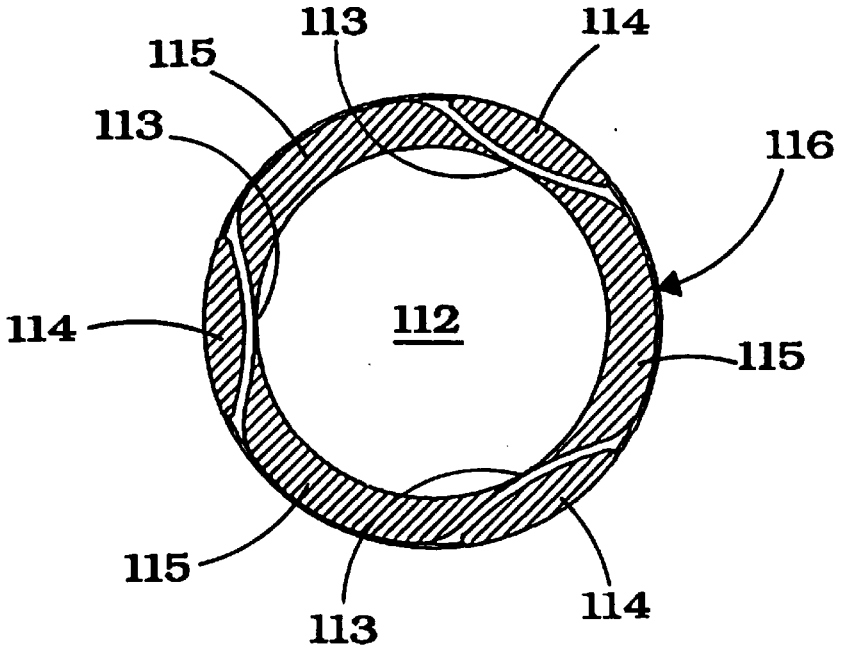
FIG. 28 is a cross-sectional view of a eleventh form of our invention, similar to that shown in FIG. 1, but having a circular inner wall, and a different form of tear line.

FIG. 28 is another embodiment of our invention, shown in cross-section, in which the interior 112 is circular in cross-section and three tear lines 113 are positioned equidistantly from each other along the outer periphery of the cavity. As is the case in the other embodiments of our invention, an elongated shield member 114 is positioned immediately radially outwardly and directly opposite to each one of the tear lines 113, to effectively preclude the passage of any of the shot pellets (not shown) through the circumferentially extending passages defined between the shield members 114 and the walls 115 of the tubular member which are located at opposite sides of the tear line 113. The numeral 116 identifies the tubular member, generally, which is otherwise similar to the tubular member 39 of FIG. 1.

Figure 29:
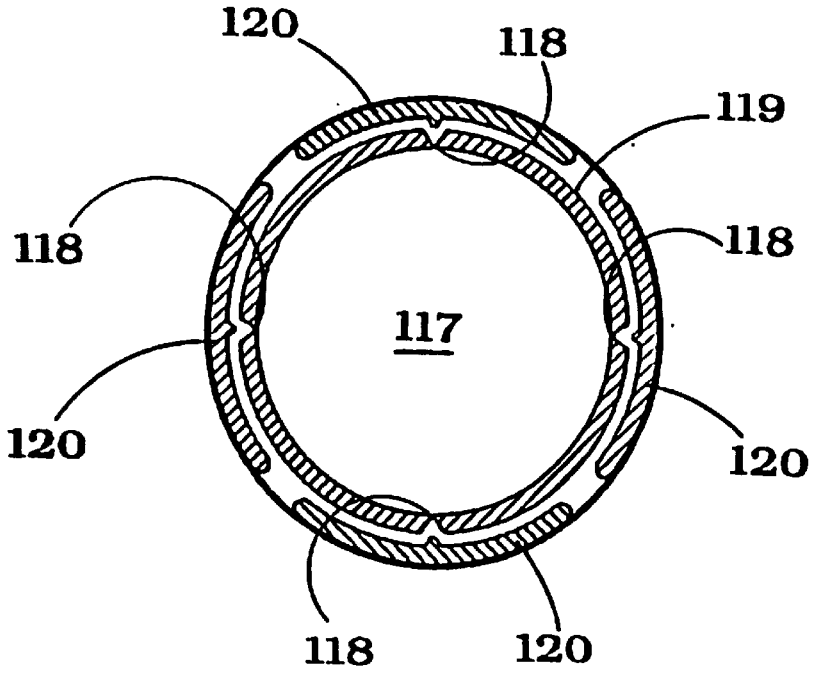
FIG. 29 is a cross-sectional view of a twelfth embodiment of our invention, similar to that shown in FIG. 1, but having a circular inner wall surface and a different form of shield member.

FIG. 29 shows an additional embodiment of our invention in which the central cavity 117 of the tubular member 119 is round, and four tear lines 118 are positioned equidistantly around the interior wall of the tubular member 119. Positioned directly outwardly of each of the tear lines 118 is a concavely shaped shield member 120, which extends circumferentially in opposite directions from the area immediately opposite the tear line. Each of the shield members 120 extend upwardly from the skirt area, as is the case with each of the other shield members disclosed herein, and precludes the passage of shot through any of the circumferential passages defined between the shield member 120 and the wall of the tubular member 119. Thus, it is impossible for any of the shot pellets to encounter the wall of the bore of the barrel of a gun, since the bore of the barrel causes the shield 120 to bear against the interior wall.

Figure 30:
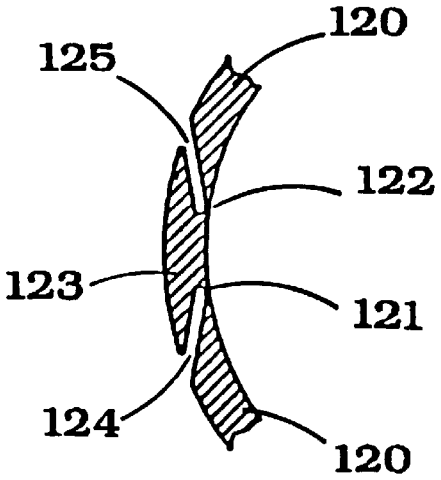
FIG. 30 is a fragmentary sectional view of a thirteenth embodiment of our invention, similar to FIG. 1, but showing a different form of shield member.

FIG. 30 is a fragmentary sectional view of a portion of the wall structure of a shot pouch, similar in construction to the tubular member 39 of FIG. 1, except as described herein, in which sections of the tubular wall 120 is substantially thinned to provide a plurality of pairs of tear lines such as 121 and 122. A shield member 123 is provided directly opposite the two tear lines and defines a pair of circumferentially extending passages 124 and 125, which extend in opposite directions from the two tear lines 121 and 122. As shown, the two passages 124 and 125 are narrow and preclude the passage of a shot pellet therethrough. The shield member 123 prevents the passages from enlarging sufficiently to permit a shot pellet to pass therethrough and engage the bore of the barrel of a shotgun. The shield member 123 is held in place, of course, by the wall of the barrel of the gun.

Figure 31:
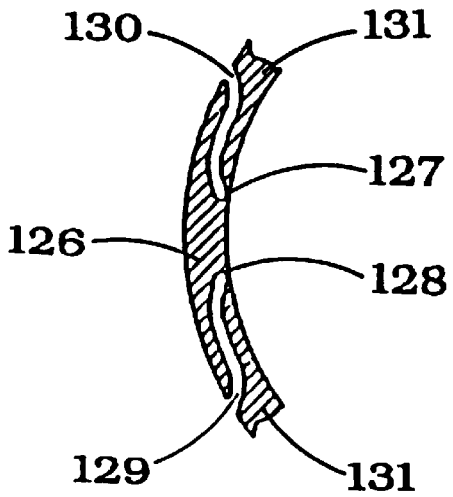
FIG. 31 is a fragmentary sectional view of a fourteenth embodiment of our invention, similar to portions of FIG. 1, but showing another form of shield member.

FIG. 31 shows a second fragmentary sectional view of a portion of a shot cup, in which the shield member 126 is disposed opposite the two tear lines 127, 128 and cooperatively define the circumferentially extending passages 129 and 130 with the wall structure 131 of the shot pouch. This design differs from that shown in FIG. 30 in that the shield member 126 extends farther circumferentially than the shield member 123. The wall structure 131 which cooperates with the shield member to define the passage 129 and 130, is more slender in these passage-defining portions than in the shot pouch shown in FIG. 32.

Figure 32:
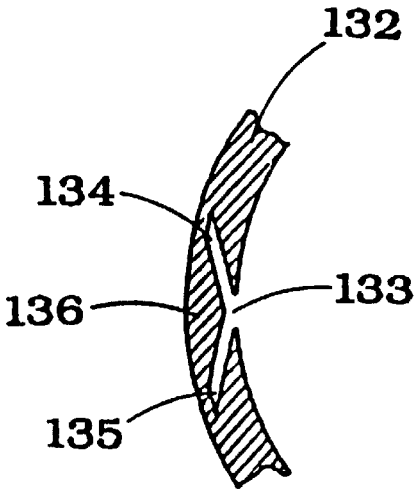
FIG. 32 is a fragmentary sectional view of a fifteenth embodiment of our invention, similar to portions of FIG. 1, but showing another form of shield member.

FIG. 32 is a third fragmentary sectional view of a portion of the wall structure of a shot pouch, similar to that shown in FIG. 1, in which the inner surface of the wall structure 132 has a narrow slit 133, which communicates with a pair of circumferentially extending passages 134, 135. A shield member 136 is positioned directly oppositely and outwardly of the opening 133, and assists in defining the passages 134, 135, which are very narrow and preclude the passage of a shot pellet therethrough. The shot will follow the path of least resistance, and therefore will seek to escape through the two passages 134, 135, which entrance is precluded by the shield member 136.

Figure 33:
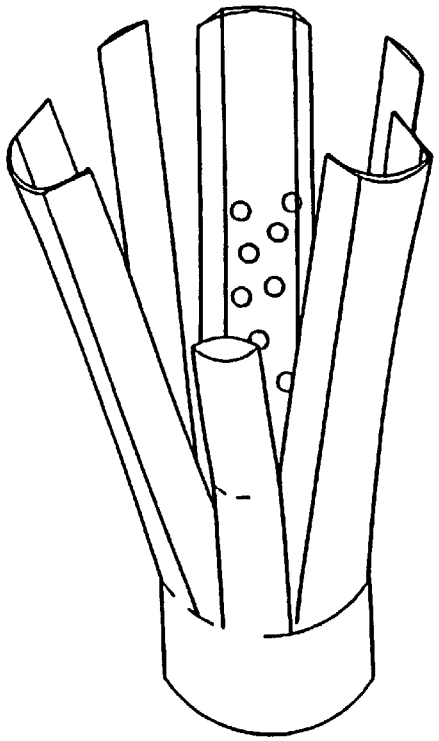
FIG. 33 is a perspective view of one of our shot pouches, after it has been fired from the barrel of a gun and has opened and separated from the shot charge.

FIG. 33 shows one of our shot pouches as it is stripped, immediately after having been fired, from the shot previously contained therein, by the air forces which it encounters as it leaves the barrel of the gun. It will be seen that the shield member, as well as the tongues, immediately flare outwardly.

Figure 34:
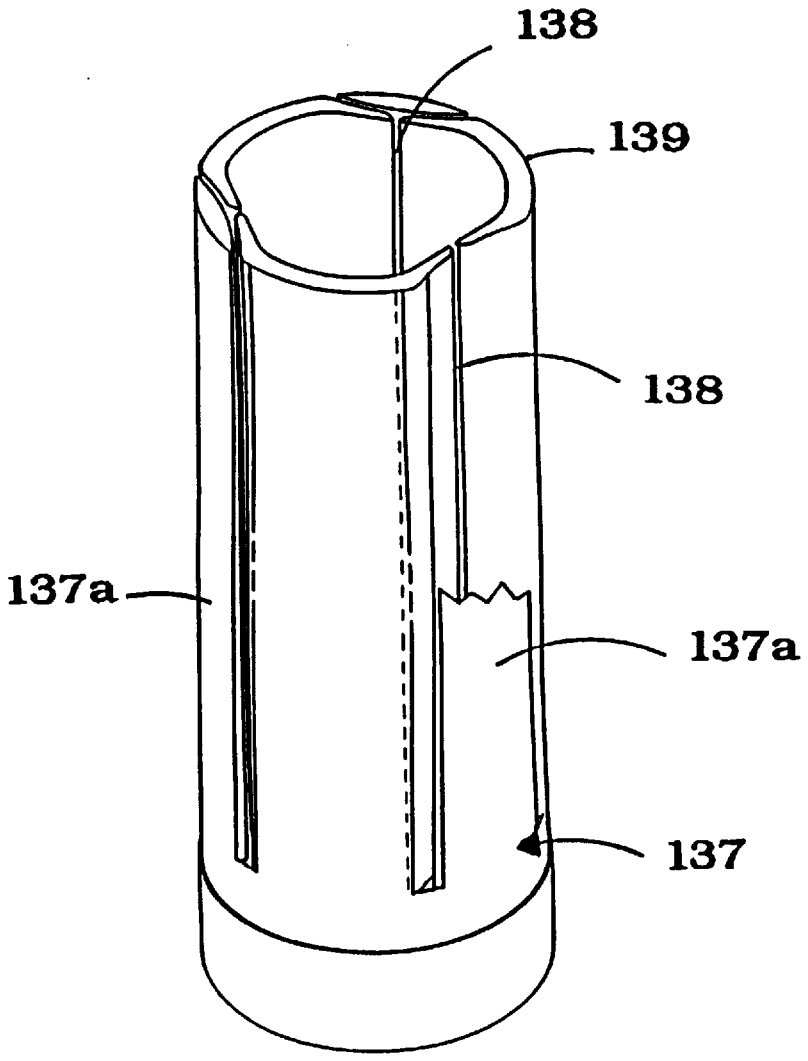
FIG. 34 is an enlarged perspective view of a shot pouch in which slits, the equivalent of the thinned areas of the other pouches as shown, are utilized in combination with the same type of shield member.

FIG. 34 shows a shot pouch 137, similar to pouch 39 of FIG. 1 in all respects, except that slits 138 are utilized in lieu of the thinned areas 42 of FIG. 1. As shown, the slits 138 define tongues 139 therebetween and the shield members 137*a* are disposed radially opposite, and immediately, outside the slits.

The various shot pouches, which have been shown, are designed to be utilized as a component of a shotshell, such as is shown in FIG. 35. Normally, it will include a conventional plastic casing 140, which is secured within a metal head 141, at the center of which there is a primer 142 which functions to fire the propellant 143, which is positioned immediately behind the shot pouch 144. As indicated previously, the skirt of the shot pouch perfects a seal to prevent the escape of gases produced by the ignited propellant. Each of the shot pouches described herein are designed to be so utilized.

The function of the shot pouches described herein is highly similar for each design. Basically, upon firing, the propellant creates great pressure behind the shot pouch, which causes the shot load to attempt to shift rearwardly, which in turn induces substantial radial pressures. These radial pressures cause the tear line to be torn, and the shot pellets seek to escape along the line of least resistance, which is through the torn tear line. The shield member, which is positioned directly opposite and radially outwardly of the tear line, and which defines circumferentially narrow passages in opposite directions from the tear line, precludes the escape of any of the shot pellets, and prevents their contact with the inner surface or bore of the wall of the barrel of the shotgun. Thus, scoring of the bore is avoided. In addition, the spherical forms of the shot pellets are retained, because their original hardness has not been reduced by annealing, and they do not come into contact with the bore of the barrel. As a consequence, the shot pellets do not suffer a flattening which, in softer shot pellets, will cause ballistic deficiencies.

In addition, the tear line/shield member combination, and the generally triangular shape of the interior of the shotshell are effective in maintaining the shot in aligned relation, longitudinally of the shot pouch to a greater extent than is possible with the cylindrically shaped cavities of shot pouches heretofore known. As shown in FIG. 17, a post may be added as a shot alignment feature. This feature will aid in controlling the longitudinal alignment of the shot, such that one shot will be positioned directly in front of another during firing. This alignment helps in reducing the radial forces by causing the reaction force vector to be directed rearwardly only.

As shown hereinabove, our invention relates to a shotgun shell, particularly to the wad column and shot protector combination. The object of the invention is to provide improved new and novel shot protectors for use in shotgun cartridges containing hard, dense shot. The shot protector provides barrel protection by preventing the shot from contacting the barrel, once fired. Furthermore, the shot pattern density is enhanced by maintaining the shot roundness through utilization of the design protection features.

The pouch designs shown are adaptable to different gauges, so they may be manufactured in different sizes. This helps in maintaining different volumes, lengths, weights, and space requirements of different loads within the shotshell requirements.

Our shot pouch design is essentially a round cylinder on the outside, with a core on the inside which is generally shaped triangularly. The pouch has a pre-weakened wall feature generally in three equally spaced locations. There are generally three petals or shield members, spaced longitudinally on the outside, directly covering and protecting the narrow pre-weakened areas. The shield members are generally oval in shape, and tend to increase in thickness toward the base. When a shotgun shell is fired, the projectile mass shifts rearwardly, creating radially directed forces. These forces applied on the walls are greater in magnitude toward the rear of the shot pouch. The sidewall thickness increases toward the rear to offset that effect. The wall thickness depends upon the specific volume requirements of certain shot sizes and weights.

The shot pouch is essentially a plastic cup, which can be easily molded from inexpensive plastic resins. To date, we have experimented with only high density polyethylene. The rear portion of the shot pouch is designed with a skirt to provide maximum pressure seal. The three shield members, which are located radially outwardly and directly opposite to the tear lines, are designed to provide protection to the barrel from the abrasion of the shot, which otherwise could slip through the torn tear line. As the pressure builds, upon the propellant ignition, the skirt of the shot pouch flares out to provide the desired pressure seal. When the pressure reaches its peak, the shot pouch will be propelled from the shell into the chamber of the barrel of the gun. The diameter of the shot pouch will expand to the diameter of the gun's chamber, and the tear line will be completely torn. Although the tear lines are designed for that purpose, they may be torn at an earlier stage. As a result of the torn tear line, the shot will seek the path of least resistance, thus trying to pass through the torn tear line. At this point, the shield member's design objective becomes active. The shield members will prevent the shot from abrading the forcing cone, as well as the barrel itself. When the projectile reaches the end of the barrel, where the choke is located, it encounters another diameter restriction, at which point the shield member design once again does its job. From the split milliseconds of firing to exiting the gun bore, the shot is being encased by the shot pouch, thus providing the necessary barrel protection.

When the shot pouch exits the bore of the barrel of the gun, it encounters tremendous air resistance, which creates drag forces thereupon. Because of the unique shot pouch design, the wall areas subjected to air flow are increased markedly, thus increasing air resistance. This in turn helps, as shown in FIG. 33, in stripping the shot pouch from the shot at an earlier stage, when compared to a standard shot pouch. This ultimately maximizes the shot pattern density by reducing the chances of trapped shot and/or shot pouch tumbling.

The shot pouch having a triangular shaped core enhances the design of the shield members and their functions. The triangular shaped core also controls the shot stacking in an alternating pattern from one row to the next. This in turn provides fewer variations in loading weight and contributes to more consistent ballistic performance.

Each of the shot pouches shown in the drawings are constructed similarly to the construction shown in FIG. 1 except, of course, where they obviously differ, as shown in the particular drawing. Thus, the tear lines extend longitudinally of the pouch from a point adjacent the rear end of the pouch and terminate at the mouth. Likewise, each of the shield members extend the full length of the tear lines, and a skirt is provided at the rear.

In conclusion, we have tested a number of designs shown herein, particularly the preferred form shown in FIGS. 1–5, as well as those shown in FIGS. 6–9. We have experienced a substantial reduction in the scoring of the barrel of the shotguns in which they have been fired, and also a definite improvement in the density pattern of the shot, since this pouch permits the use of non-annealed shot, which maintains the spherical shape of the individual shot. It also thereby eliminates one step in the production of the shotshell, providing substantial savings in manufacturing costs. We are convinced by these advantages that we have made a substantial contribution in the advancement of the art.

In considering this invention, it should be remembered that the present disclosure is illustrative only and the scope of the invention should be determined by the appended claims.

We claim:

1. A one piece shot pouch for containing shot pellets therewithin, comprising a tubular member having:

(a) a closed rear end portion constructed in one piece with the remainder of said tubular member, (b) an open forward end portion, (c) tubular wall structure extending between said portions and characterized by elongated tear line areas extending longitudinally of said wall structure, and said wall structure having a generally cylindrically shaped exterior surface, and (d) a plurality of shield members constructed in one piece with said wall structure and disposed radially opposite said tear line areas in shielding position to effectively shield the bore of the barrel of a gun from damage by shot to be contained within said tubular wall structure which will otherwise extend through said tear line areas and damage the bore of a gun upon firing therein of a shotshell containing said tubular member while so loaded;

(e) said shield members being connected to said tubular member only adjacent said closed rear end portion and being otherwise separate and free of said tubular member; and (f) portions of said wall structure extending between said shield members.

2. The shot pouch defined in claim 1, wherein said tear line areas are circumferentially spaced and said shield members have a radial thickness greater than the areas of said wall structure immediately adjacent said tear lines.

3. The shot pouch defined in claim 1, wherein said tear line areas comprise substantially thinned areas in said tubular wall structure.

4. The shot pouch defined in claim 1, wherein said tear line areas comprise pre-cut slits in said wall structure.

5. The shot pouch defined in claim 1, wherein said shield members are elongated and are discrete relative to said tubular wall structure.

6. The shot pouch defined in claim 1, wherein said shield members extend circumferentially in opposite directions beyond said tear line areas which they shield.

7. The shot pouch defined in claim 1, wherein said shield members are generally oval in cross-sectional shape.

8. The shot pouch defined in claim 1, wherein said tear line areas extend generally parallel to each other.

9. The shot pouch defined in claim 1, wherein said shield members extend longitudinally of at least one of said tear line areas.

10. The shot pouch defined in claim 1, wherein said tubular member has a plurality of tear line areas and shield members and said tear line areas are generally equally spaced circumferentially of said tubular member.

11. The shot pouch defined in claim 1, wherein the interior of said tubular wall structure is generally triangular in cross-sectional shape.

12. The shot pouch defined in claim 1, wherein the interior of said tubular wall structure is generally circular in cross-sectional shape.

13. The shot pouch defined in claim 1, wherein the interior of said tubular wall structure is generally triangular in cross-sectional shape and one of said tear line areas is disposed directly radially inwardly of one of said shield members.

14. The shot pouch defined in claim 1, wherein said shield members have opposite ends and has an end thereof connected to said tubular wall structure adjacent said rear end portion and its other end is free.

15. The shot pouch defined in claim 1, wherein said shield members are elongated and have opposite ends, one end of said shield members being connected to said tubular member adjacent said rear end portion and its other end being disposed adjacent said forward end portion.

16. The shot pouch defined in claim 1, wherein said tear line areas are comprised of a plurality of slits which are spaced circumferentially of said tubular structure and one of said shield members extends upwardly from said rear portion and is disposed directly outwardly and oppositely along one of said slits to a point adjacent said open forward end portion.

17. The shot pouch defined in claim 1, wherein said tubular wall structure is comprised of a plurality of elongated pre-slit tongues extending forwardly from said rear end portion, and joined to each other by one of said tear line areas, and (e) a shield member disposed directly radially opposite each of said tear line areas and extending longitudinally thereof.

18. The shot pouch defined in claim 1, wherein each of said shield members has a free end disposed adjacent said open forward end portion.

19. The shot pouch defined in claim 1, wherein said shield members have a longitudinal center line which is disposed generally radially opposite said tear line.

20. The shot pouch defined in claim 1, wherein each of said shield members is hingedly connected to said tubular member.

21. The shot pouch defined in claim 1, wherein said shield members extends longitudinally of said tubular member.

22. The shot pouch defined in claim 1, wherein each of said shield members extends externally of said tubular member.

23. The shot pouch defined in claim 1, wherein each of said shield members has an exterior surface area facing one of said tear lines and conforming in shape to the exterior surface of said tubular member adjacent to said tear line.

24. The shot pouch defined in claim 1, and a rearwardly extending skirt carried by said rear end portion.

25. The shot pouch defined in claim 1, wherein each of said shield members has substantially greater circumferential dimensions than said tear line areas.

26. The shot pouch defined in claim 1, and a centrally disposed post extending forwardly from said rear end portion.

27. The shot pouch defined in claim 1, wherein said tear lines are each disposed centrally of one of said shield members.

28. The shot pouch defined in claim 1, wherein said tubular wall structure is made of plastic and said tear lines are approximately 0.002" thick.

29. The shot pouch defined in claim 1, wherein said shield members are generally oval in cross-sectional shape.

30. A one piece shot pouch comprising:

a. a tubular member having an open forward end portion, a closed rear end portion, and tubular wall structure extending between said portions and defining a hollow interior for containing shot therein, b. said wall structure having elongated tear line areas which extend longitudinally of said tubular member, and c. a plurality of shield members spaced circumferentially of said tubular member and constructed in one piece with said wall structure in juxtaposition with said areas and disposed radially opposite said tear line areas in position to shield the bore of the barrel of a gun from damage by shot which will otherwise extend through said tear line areas and damage the bore of the barrel of the gun, upon firing thereof, (d) said shield members being connected to said tubular member only adjacent said closed rear end portion and being otherwise separate and free of said tubular member; and (e) portions of said wall structure extending between said shield members.

* * * * *

UNITED STATES PATENT AND TRADEMARK OFFICE

CERTIFICATE OF CORRECTION

PATENT NO. : 5,874,689

DATED : February 23, 1999

INVENTOR(S) : Y.F. Alkhatib, J.J. Rubatt, and J.H. Riedel

It is certified that error appears in the above-identified patent and that said Letters Patent is hereby corrected as shown below:

In the Abstract, line 19, delete "0.0601" " and insert --0.060"--.

Column 9, line 11, delete "32" and insert --30--.

Claim 14, line 2, delete "has" and insert --have--.

Claim 14, line 4, delete "its" and insert --their--.

Signed and Sealed this

Twenty-first Day of September, 1999

*Attest:*

Q. TODD DICKINSON

*Attesting Officer*

*Acting Commissioner of Patents and Trademarks*